US011423848B2

(12) United States Patent
Kwon et al.

(10) Patent No.: US 11,423,848 B2
(45) Date of Patent: Aug. 23, 2022

(54) DISPLAY DEVICE AND METHOD OF OPERATING THE SAME

(71) Applicant: SAMSUNG DISPLAY CO., LTD., Yongin-si (KR)

(72) Inventors: Sang An Kwon, Yongin-si (KR); Kyun Ho Kim, Yongin-si (KR); Woo Mi Bae, Yongin-si (KR); Jun Woo Son, Yongin-si (KR)

(73) Assignee: SAMSUNG DISPLAY CO., LTD., Yongin-Si (KR)

( * ) Notice: Subject to any disclaimer, the term of this patent is extended or adjusted under 35 U.S.C. 154(b) by 0 days.

(21) Appl. No.: 17/189,614

(22) Filed: Mar. 2, 2021

(65) Prior Publication Data

US 2021/0398494 A1 Dec. 23, 2021

(30) Foreign Application Priority Data

Jun. 19, 2020 (KR) ..... 10-2020-0075227

(51) Int. Cl.
*G09G 3/32* (2016.01)
*G09G 3/3291* (2016.01)
*G09G 5/06* (2006.01)

(52) U.S. Cl.
CPC ..... *G09G 3/3291* (2013.01); *G09G 5/06* (2013.01); *G09G 2310/08* (2013.01); *G09G 2320/0276* (2013.01); *G09G 2320/0666* (2013.01)

(58) Field of Classification Search
CPC ..... G09G 3/3611–3696
See application file for complete search history.

(56) References Cited

U.S. PATENT DOCUMENTS 8,619,104 B2 12/2013 Umezaki et al.
2015/0091949 A1* 4/2015 Kim ..... G09G 3/3648 345/690
2018/0211602 A1* 7/2018 Cho ..... G09G 3/3258
2020/0043396 A1* 2/2020 Dai ..... G09G 3/2003

FOREIGN PATENT DOCUMENTS

KR 10-1814222 1/2018

* cited by examiner

*Primary Examiner* — Roy P Rabindranath
(74) *Attorney, Agent, or Firm* — F. Chau & Associates, LLC

(57) ABSTRACT

A display device comprises a timing controller which provides data comprising a pre-emphasis value and an image data value, and a data driver which supplies to data lines a pre-emphasis voltage generated based on the pre-emphasis value during a first period of a horizontal period, and supplies to the data lines a data voltage generated based on the image data value during a second period of the horizontal period. The timing controller provides data based on which the pre-emphasis value is changed in correspondence with one screen mode selected from a plurality of screen modes having different target color coordinates.

20 Claims, 16 Drawing Sheets

FIG. 4

15

| n \ (n-1) | 0 | 8 | 16 | 32 | 48 | 64 | 96 | 224 | 255 |
|---|---|---|---|---|---|---|---|---|---|
| 0 | 0 | 0 | 0 | 0 | 0 | 0 | 0 | 0 | 0 |
| 8 | 8 | 8 | 4 | 4 | 4 | 4 | 3 | 3 | 2 |
| 16 | 17 | 16 | 16 | 14 | 14 | 14 | 13 | 10 | 6 |
| 32 | 45 | 42 | 34 | 32 | 32 | 31 | 31 | 21 | 13 |
| 48 | 67 | 63 | 56 | 50 | 48 | 47 | 43 | 27 | 16 |
| 64 | 86 | 82 | 70 | 68 | 66 | 64 | 60 | 32 | 19 |
| 96 | 129 | 117 | 112 | 107 | 102 | 98 | 96 | 71 | 29 |
| 224 | 245 | 236 | 234 | 232 | 230 | 228 | 226 | 224 | 201 |
| 255 | 255 | 255 | 255 | 255 | 255 | 255 | 255 | 255 | 255 |

FIG. 10A

15_1

| n \ (n-1) | 0 | 8 | 16 | 32 | 48 | 64 | 96 | 224 | 255 |
|---|---|---|---|---|---|---|---|---|---|
| 0 | 0 | 0 | 0 | 0 | 0 | 0 | 0 | 0 | 0 |
| 8 | 19 | 8 | 15 | 15 | 15 | 15 | 14 | 14 | 13 |
| 16 | 28 | 27 | 16 | 25 | 25 | 25 | 24 | 21 | 17 |
| 32 | 56 | 53 | 45 | 32 | 43 | 42 | 42 | 32 | 24 |
| 48 | 78 | 74 | 67 | 61 | 48 | 58 | 54 | 38 | 27 |
| 64 | 97 | 93 | 81 | 79 | 77 | 64 | 71 | 43 | 30 |
| 96 | 140 | 128 | 123 | 118 | 113 | 109 | 96 | 82 | 40 |
| 224 | 255 | 247 | 245 | 243 | 241 | 239 | 237 | 224 | 212 |
| 255 | 255 | 255 | 255 | 255 | 255 | 255 | 255 | 255 | 255 |

FIG. 10B

15_2

| n \ (n-1) | 0 | 8 | 16 | 32 | 48 | 64 | 96 | 224 | 255 |
|---|---|---|---|---|---|---|---|---|---|
| 0 | 0 | 0 | 0 | 0 | 0 | 0 | 0 | 0 | 0 |
| 8 | 65 | 8 | 61 | 61 | 61 | 61 | 60 | 60 | 59 |
| 16 | 74 | 73 | 16 | 71 | 71 | 71 | 70 | 67 | 63 |
| 32 | 102 | 99 | 91 | 32 | 89 | 88 | 88 | 78 | 70 |
| 48 | 124 | 120 | 113 | 107 | 48 | 104 | 100 | 84 | 73 |
| 64 | 143 | 139 | 127 | 125 | 123 | 64 | 117 | 89 | 76 |
| 96 | 186 | 174 | 169 | 164 | 519 | 155 | 96 | 128 | 86 |
| 224 | 255 | 255 | 255 | 255 | 255 | 255 | 255 | 224 | 255 |
| 255 | 255 | 255 | 255 | 255 | 255 | 255 | 255 | 255 | 255 |

FIG. 10C

15_3

| n \ (n-1) | 0 | 8 | 16 | 32 | 48 | 64 | 96 | 224 | 255 |
|---|---|---|---|---|---|---|---|---|---|
| 0 | 0 | 0 | 0 | 0 | 0 | 0 | 0 | 0 | 0 |
| 8 | 4 | 8 | 0 | 0 | 0 | 0 | 0 | 0 | 0 |
| 16 | 13 | 12 | 16 | 10 | 10 | 10 | 9 | 6 | 2 |
| 32 | 41 | 38 | 30 | 32 | 28 | 27 | 27 | 17 | 9 |
| 48 | 63 | 59 | 52 | 46 | 48 | 43 | 39 | 23 | 12 |
| 64 | 82 | 78 | 66 | 64 | 62 | 64 | 60 | 28 | 15 |
| 96 | 125 | 113 | 108 | 103 | 98 | 94 | 96 | 67 | 25 |
| 224 | 241 | 232 | 230 | 228 | 226 | 224 | 222 | 224 | 197 |
| 255 | 255 | 255 | 255 | 255 | 255 | 255 | 255 | 255 | 255 |

DISPLAY DEVICE AND METHOD OF OPERATING THE SAME

CROSS-REFERENCE TO RELATED APPLICATION

This application claims priority under 35 U.S.C. § 119 to Korean Patent Application No. 10-2020-0075227, filed in the Korean Intellectual Property Office on Jun. 19, 2020, the entire contents of which are incorporated by reference.

TECHNICAL FIELD

The present disclosure relates to display devices, and more particularly relates to a display device with pre-emphasis and a method of controlling the same.

DISCUSSION OF RELATED ART

As information technology is developed, the role of a display device that serves as a connection medium between a user and information is increasingly emphasized. In response to this, the use of a display device such as a liquid crystal display device and/or an organic light emitting display device is increasing.

The display device may include pixels connected to each of scan lines and data lines, a scan driver for driving the scan lines, and a data driver for driving the data lines.

In order to stably display an image in such a display device, a data signal is stably supplied to the pixels within a predetermined time period (that is, a time period in which a scan signal is supplied). However, the data signal might not be fully charged or discharged to a desired voltage (target voltage) during a period in which a scan signal is supplied due to an increase of resolution and/or enlargement of a panel.

SUMMARY

According to an exemplary embodiment, in case a data signal is not fully charged or discharged to a desired target voltage during a period in which a scan signal is supplied, a method of supplying a pre-emphasis voltage is provided. The method of supplying the pre-emphasis voltage may temporarily reduce a driving delay time by temporarily applying a pre-emphasis voltage that is larger than a data voltage.

An exemplary embodiment display device may provide various screen modes that may change a background color to a warmer or cooler color in consideration of a viewing environment and a preference of a user. Since a target color coordinate is set differently for each screen mode, white balance for correcting the target color coordinate may be applied.

Thus, when the white balance is applied, since an RGB ratio of a chromaticity diagram (see, for example, CIE 1931) is changed, data to be compensated is also changed. Therefore, when a data charge time is insufficient, such as due to an increase of resolution and/or enlargement of the display device, an exemplary embodiment may maintain linearity of the color coordinate for each screen mode.

According to an exemplary embodiment, a provided display device may be capable of maintaining linearity of a color coordinate when a screen mode of a high-resolution display panel is changed.

According to an exemplary embodiment, a provided method of driving a display device may be capable of maintaining linearity of a color coordinate when a screen mode of a high-resolution display panel is changed.

It shall be understood that embodiments of the disclosure are not limited to the above-described examples, and may be variously expanded without departing from the spirit and scope of the disclosure.

A display device according to an exemplary embodiment of the present disclosure comprises a timing controller which provides data comprising a pre-emphasis value and an image data value, and a data driver which supplies a pre-emphasis voltage generated based on the pre-emphasis value during a first period of a horizontal period to data lines, and supplies a data voltage generated based on the image data value during a second period of the horizontal period to the data lines.

The timing controller provides data based on which the pre-emphasis value is changed in correspondence with one screen mode selected from a plurality of screen modes having different target color coordinates.

The plurality of screen modes may comprise a first screen mode having a first target color coordinate, a second screen mode having a second target color coordinate, and a third screen mode having a third target color coordinate.

The first to third target color coordinates may each be defined as a vector, each vector including at least a first rectangular coordinate and a second rectangular coordinate. The first rectangular coordinate and the second rectangular coordinate of the second target color coordinate may be greater than the first rectangular coordinate and the second rectangular coordinate of the first target color coordinate, and the first rectangular coordinate and the second rectangular coordinate of the third target color coordinate may be less than the first rectangular coordinate and the second rectangular coordinate of the first target color coordinate.

The timing controller may compare the image data value of a previous horizontal period with the image data value of a current horizontal period to determine the pre-emphasis value corresponding to the current horizontal period.

When the first screen mode is selected, the timing controller may obtain a difference value between the first target color coordinate and a measured color coordinate for each grayscale, calculate a first compensation value using the difference value, and add the first compensation value to the pre-emphasis value. When the second screen mode is selected, the timing controller may obtain a difference value between the second target color coordinate and the measured color coordinate for each grayscale, calculate a second compensation value using the difference value, and add the second compensation value to the pre-emphasis value. And when the third screen mode is selected, the timing controller may obtain a difference value between the third target color coordinate and the measured color coordinate for each grayscale, calculate a third compensation value using the difference value, and add the third compensation value to the pre-emphasis value.

The first to third compensation values may be calculated using the following formula.

Compensation value$=(\Delta y/0.001)+(\Delta y-\Delta x)/0.001$ (where $\Delta x$ is a difference value between a target coordinate and a first coordinate of a measured coordinate, and $\Delta y$ is a difference value between the target coordinate and a second coordinate of the measured coordinate)

The second compensation value may be greater than or equal to the first compensation value, and the third compensation value may be less than or equal to the first compensation value.

The timing controller may determine the pre-emphasis value based on a lookup table in which the pre-emphasis value corresponding to the image data value of a previous horizontal period and the image data value of a current horizontal period is written.

The lookup table may comprise a first lookup table corresponding to the first mode, a second lookup table corresponding to the second mode, and a third lookup table corresponding to the third mode.

The pre-emphasis value comprised in the second lookup table may be greater than or equal to the pre-emphasis value comprised in the corresponding first lookup table, and the pre-emphasis value comprised in the third lookup table may be less than or equal to the pre-emphasis value comprised in the corresponding first lookup table.

The display device may further comprise a gamma reference voltage supply which supplies a gamma reference voltage.

The gamma reference voltage may comprise a lowest gamma reference voltage corresponding to a lowest grayscale value and a highest gamma reference voltage corresponding to a highest grayscale value.

The data driver may comprise a grayscale voltage generator that divides the gamma reference voltage to generate a plurality of grayscale voltages.

The data driver may select any one of the grayscale voltages corresponding to the pre-emphasis value to generate the pre-emphasis voltage, and select any one of the grayscale voltages corresponding to the image data value to generate the data voltage.

The display device may further comprise a scan driver which supplies a scan signal through scan lines, and a pixel comprising a plurality of pixels connected to the scan lines and the data lines.

A method of driving a display device according to an embodiment of the disclosure comprises providing data comprising a pre-emphasis value and an image data value, supplying a gamma reference voltage, and supplying a pre-emphasis voltage generated based on the pre-emphasis value and the gamma reference voltage during a first period of a horizontal period to data lines, supplying a data voltage generated based on the image data value and the gamma reference voltage during a second period of the horizontal period to the to the data lines.

In providing the data comprising the pre-emphasis value and the image data value, the pre-emphasis value is changed in correspondence with one screen mode selected from a plurality of screen modes having different target color coordinates.

The plurality of screen modes may comprise a first screen mode having a first target color coordinate, a second screen mode having a second target color coordinate, and a third screen mode having a third target color coordinate.

The first to third target color coordinates may each be defined as a vector, each vector including at least a first coordinate and a second coordinate of rectangular coordinates, the first coordinate and the second coordinate of the second target color coordinate may be greater than the first coordinate and the second coordinate of the first target color coordinate, and the first coordinate and the second coordinate of the third target color coordinate may be less than the first coordinate and the second coordinate of the first target color coordinate.

Providing the data comprising the pre-emphasis value and the image data value may comprise comparing the image data value of a previous horizontal period with the image data value of a current horizontal period to determine the pre-emphasis value corresponding to the current horizontal period.

Providing the data comprising the pre-emphasis value and the image data value may further comprise obtaining a difference value between the first target color coordinate and a measured color coordinate for each grayscale, calculating a first compensation value using the difference value, and adding the first compensation value to the pre-emphasis value, when the first screen mode is selected, obtaining a difference value between the second target color coordinate and the measured color coordinate for each grayscale, calculating a second compensation value using the difference value, and adding the second compensation value to the pre-emphasis value, when the second screen mode is selected, and obtaining a difference value between the third target color coordinate and the measured color coordinate for each grayscale, calculating a third compensation value using the difference value, and adding the third compensation value to the pre-emphasis value, when the third screen mode is selected.

The first to third compensation values may be calculated using the following formula.

Compensation value=$(\Delta y/0.001)+(\Delta y-\Delta x)/0.001$ (where $\Delta x$ is a difference value between a target coordinate and a first coordinate of a measured coordinate, and $\Delta y$ is a difference value between the target coordinate and a second coordinate of the measured coordinate)

In the display device according to embodiments of the disclosure, linearity of a color coordinate may be maintained when a screen mode of a high-resolution display panel is changed by applying a data voltage differently for each screen mode.

The method of driving the display device according to the embodiments of the disclosure may maintain linearity of a color coordinate when a screen mode of a high-resolution display panel is changed by applying a data voltage differently for each screen mode.

In an exemplary embodiment, a display circuit includes a data driver configured to sequentially output to a data line a first data voltage, a pre-emphasis voltage, and a second data voltage, wherein the pre-emphasis voltage is based on each of the first data voltage, the second data voltage, and a screen mode dynamically selected from among a plurality of screen modes having different target color coordinates. The display circuit may include a paged lookup table, each page containing values corresponding to pre-emphasis voltages based on the first data voltage and the second data voltage for at least one of the plurality of screen modes.

Embodiments of the disclosure are not limited to the above-described exemplary embodiments, and may be variously expanded without departing from the scope and spirit of the present disclosure.

BRIEF DESCRIPTION OF THE DRAWINGS

The above and other features of the disclosure will become more apparent by describing in further detail embodiments thereof with reference to the accompanying drawings, in which:

FIG. 4 is a tabular diagram illustrating a lookup table according to an embodiment of the disclosure;

FIGS. 10A to 10C are tabular diagrams illustrating lookup tables created for each screen mode according to an embodiment;

DETAILED DESCRIPTION

Figure 1:
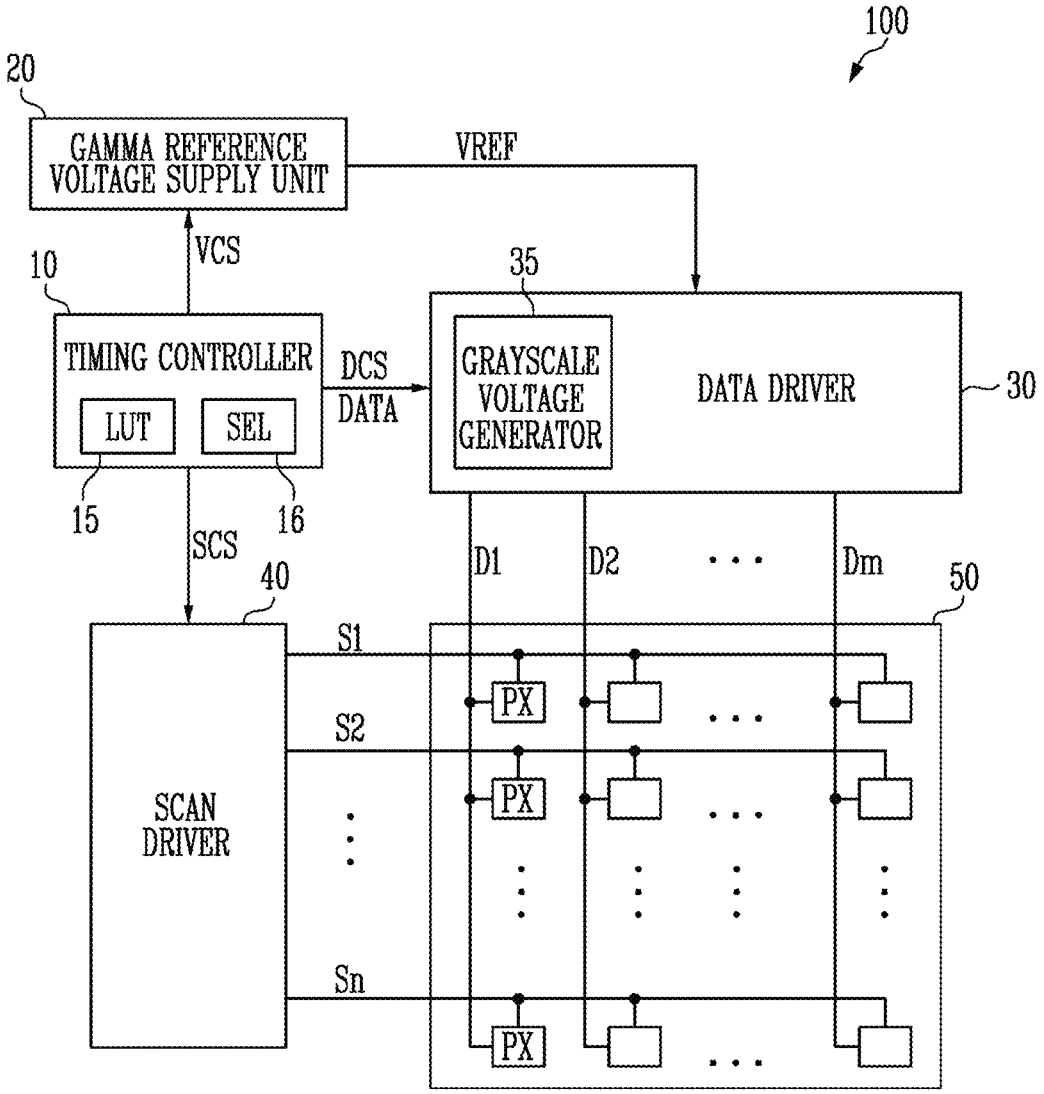
FIG. 1 is a block diagram schematically illustrating a display device 100 according to an embodiment of the disclosure.

Hereinafter, a preferred embodiment of the disclosure will be described in detail with reference to the accompanying drawings. The same reference numerals may be used for the same components in the drawings, and repetitive description for the same components may be omitted.

FIG. 1 schematically illustrates a display device 100 according to an embodiment of the disclosure.

Referring to FIG. 1, the display device 100 according to an embodiment of the disclosure may include a timing controller 10, a gamma reference voltage supply 20, a data driver 30, a scan driver 40, and a pixel array 50.

The timing controller 10 may receive synchronization signals, a clock signal, and the like for controlling image data and display of the image data. The timing controller 10 may correct the image data input from the outside to be suitable for image display on the pixel array 50, and supply the corrected data DATA to the data driver 30. The data DATA may include an image data value for the image display and a pre-emphasis value for applying pre-emphasis to the image data value.

The timing controller 10 may output a data control signal DCS for controlling operation timing of the data driver 30 and a scan control signal SCS for controlling operation timing of the scan driver 40. In addition, the timing controller 10 may output a voltage control signal VCS for controlling operation timing of the gamma reference voltage supply 20 and a voltage level of a gamma reference voltage VREF.

The gamma reference voltage supply 20 may supply the gamma reference voltage VREF to the data driver 30. Here, the gamma reference voltage VREF may include a lowest gamma reference voltage corresponding to a lowest grayscale value and a highest gamma reference voltage corresponding to a highest grayscale value.

In an embodiment, the gamma reference voltage supply 20 may include a DC-DC converter and a PWM controller, and may be configured with another circuit capable of generating the gamma reference voltage VREF and changing the voltage level of the gamma reference voltage VREF.

The data driver 30 may be connected to data lines D1 to Dm, and may supply data signals to the pixel array 50 through the data lines D1 to Dm. The data driver 30 may convert the data DATA supplied from the timing controller 10 into an analog data signal or voltage. The data driver 30 may output a grayscale voltage corresponding to the data DATA in response to the data control signal DCS of the timing controller 10. Here, the data DATA may include the pre-emphasis value and the image data value.

The data driver 30 may receive the gamma reference voltage VREF from the gamma reference voltage supply 20.

The data driver 30 may supply a pre-emphasis voltage generated based on the pre-emphasis value and the gamma reference voltage VREF during a first period of a horizontal period to the data lines D1 to Dm. In addition, the data driver 30 may supply the data voltage generated based on the image data value and the gamma reference voltage VREF during a second period of the horizontal period. The data signal may include the pre-emphasis voltage and the data voltage.

In an embodiment, the data driver 30 may include a grayscale voltage generator 35 that divides the gamma reference voltage VREF to generate a plurality of grayscale voltages. However, a formation position of the grayscale voltage generator 35 is not limited thereto, and in an embodiment, the grayscale voltage generator 35 may be included in the gamma reference voltage supply 20. The data driver 30 may select any one of the grayscale voltages corresponding to the pre-emphasis value to generate the pre-emphasis voltage, and may select any one of the grayscale voltages corresponding to the image data value to generate the data voltage.

The scan driver 40 may be connected to scan lines S1 to Sn and may supply a scan signal to the pixel array 50 through the scan lines S1 to Sn. Specifically, the scan driver 40 may output the scan signal while shifting a level of a gate voltage in response to the scan control signal SCS of the timing controller 10. In an embodiment, the scan driver 40 may be configured with a plurality of stage circuits, and sequentially supply the scan signal to the scan lines S1 to Sn.

The pixel array 50 may display an image in correspondence with the data signal supplied from the data driver 30 and the scan signal supplied from the scan driver 40. The pixel array 50 may be connected to the scan lines S1 to Sn and the data lines D1 to Dm, and may include a plurality of pixels PX arranged in a matrix form.

Specifically, the pixels PX are selected in a of a horizontal line in correspondence with the scan signal supplied to any one of the scan lines S1 to Sn. Each of the pixels PX selected by the scan signal may receive the data signal from the data line (that is, from any one of D1 to Dm) connected thereto. Each of the pixels PX receiving the data signal may emit light at a predetermined luminance corresponding to the data signal. Each of the pixels PX may include sub-pixels displaying red, green, and blue. However, the color emitted by the sub-pixel is not limited thereto. For example, each of the pixels PX may include sub-pixels displaying red, green, blue, and white.

The data signal is stably supplied to the pixels PX within a predetermined time (that is, a period in which the scan signal is supplied) to stably display an image from the pixel array 50. However, due to an increase of resolution and enlargement of a panel, cases might occur where the data signal is not fully charged or discharged to a desired target voltage during a period in which the scan signal is supplied.

In order to compensate for this, a driving delay time may be reduced by temporarily applying a pre-emphasis voltage larger than the data voltage.

The timing controller 10 may determine the pre-emphasis value. Specifically, the timing controller 10 may compare the image data value of a previous horizontal period with the image data value of a current horizontal period to determine the pre-emphasis value corresponding to the current horizontal period. In addition, the timing controller 10 may change a time-wise part of the image data value to the determined pre-emphasis value.

According to an embodiment of the disclosure, the timing controller 10 may determine a pre-emphasis grayscale value based on a lookup table 15, in which the pre-emphasis value corresponding to the image data value of the previous horizontal period and the image data value of the current horizontal period are written. Values of the lookup table 15 may be set experimentally or statistically according to a tuning result from testing the display device 100.

The display device 100 may provide various screen modes that may change a background color displayed on a screen to a warmer color or a cooler color in consideration of a viewing environment and/or a preference of a user. For example, when the user adjusts the background color of the display device 100 towards a warmer color, yellow may be emphasized on the screen, and conversely, when the user adjusts the background color of the display device 100 towards a cooler color, blue may be emphasized on the screen.

The color of light may be referenced by either of two non-intuitively related color properties; namely the color temperature or the color display. The color temperature of light, such as the correlated color temperature (CCT), is typically measured in degrees Kelvin (K). The higher the color temperature, the closer to pure blue and the cooler the color display of the light. The lower the color temperature, the closer to pure red and the warmer the color display of the light. To the average human being, so-called warmer light has a red to yellowish appearance, while so-called cooler light has a white to bluish appearance. Thus, to be clear, warmer color display light has a lower color temperature while cooler color display light has a higher color temperature.

Since a target color coordinate is set differently for each display mode in the display device 100, a white balance for correcting this may be applied. When the white balance is applied, an RGB ratio of the color coordinate (for example, CIE 1931 of FIG. 6, infra) may vary.

When the RGB ratio of the color coordinate is changed, the timing controller 10 may change and provide the data DATA to be provided to the data driver 30. In addition, the timing controller 10 may also change and provide the pre-emphasis value to be provided to the data driver 30, in order to maintain linearity of the color coordinate. That is, the timing controller 10 may provide the data driver 30 with the data DATA of which the pre-emphasis value is changed in response to one screen mode selected among the plurality of screen modes.

A specific configuration in which the timing controller 10 changes the pre-emphasis value for each screen mode may be described in greater detail with reference to FIG. 9, infra.

Figure 2:
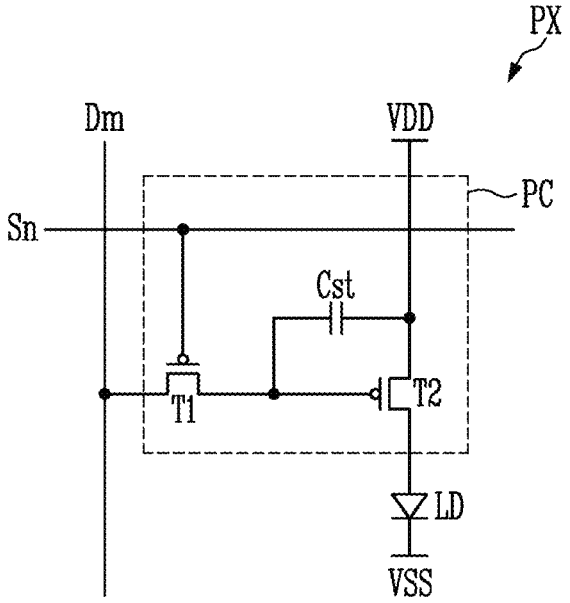
FIG. 2 is a circuit diagram illustrating an embodiment of a pixel shown in FIG. 1.

FIG. 2 illustrates an embodiment of the pixel shown in FIG. 1. In particular, in FIG. 2, for convenience of description, the pixel connected to the n-th scan line Sn and the m-th data line Dm is shown, and substantially duplicate description for the other pixels may be omitted.

Referring to FIG. 2, each pixel PX may include a light emitting diode LD, and a pixel circuit PC connected to the data line Dm and the scan line Sn to control the light emitting diode LD.

An anode electrode of the light emitting diode LD may be connected to the pixel circuit PC, and a cathode electrode of the light emitting diode LD may be connected to a second voltage VSS.

The light emitting diode LD may generate light of a predetermined luminance in correspondence with a current supplied from the pixel circuit PC.

The light emitting diode LD may be configured as an organic light emitting diode, or as an inorganic light emitting diode such as a micro light emitting diode (μLED) or a quantum dot light emitting diode. In addition, the light emitting diode LD may be a light emitting diode configured of mixture of an organic material and an inorganic material. In FIG. 2, the pixel PX includes a single light emitting diode LD, but in another embodiment, the pixel PX may include a plurality of light emitting diodes, and the plurality of light emitting diodes may be connected in series, in parallel, or in a hybrid series and parallel arrangement with each other.

The pixel circuit PC controls a current amount supplied to the light emitting diode LD in correspondence with the data signal supplied to the data line Dm when the scan signal is supplied to the scan line Sn. The pixel circuit PC includes a second transistor T2 connected between a first voltage VDD and the light emitting diode LD; a first transistor T1 connected between the second transistor T2, the data line Dm, and the scan line Sn; and a storage capacitor Cst connected between a gate electrode and a first electrode of the second transistor T2.

A gate electrode of the first transistor T1 is connected to the scan line Sn, and a first electrode is connected to the data line Dm.

In addition, a second electrode of the first transistor T1 is connected to one terminal of the storage capacitor Cst.

Here, the first electrode is set as one of a source electrode or a drain electrode, and the second electrode is set as the other electrode different from the first electrode. For example, when the first electrode is set as the source electrode, the second electrode is set as the drain electrode for a respective transistor.

The first transistor T1 connected to the scan line Sn and the data line Dm is turned on when the scan signal is supplied from the scan line Sn to supply the data signal supplied from the data line Dm to the storage capacitor Cst. Thus, the storage capacitor Cst charges a voltage corresponding to the data signal.

The gate electrode of the second transistor T2 is connected to one terminal of the storage capacitor Cst, and the first electrode of the second transistor T2 is connected to the other terminal of the storage capacitor Cst and the first voltage VDD. In addition, a second electrode of the second transistor T2 is connected to the anode electrode of the light emitting diode LD.

The second transistor T2 controls an amount of current flowing from the first voltage VDD to the second voltage VSS through the light emitting diode LD in correspondence with a voltage value stored in the storage capacitor Cst. Thus, the light emitting diode LD generates light corresponding to a current amount supplied from the second transistor T2.

Since a pixel structure of FIG. 2 described above is only an exemplary embodiment of the disclosure, the pixel PX of the disclosure is not limited to the above-described pixel structure. The pixel circuit PC may have a circuit structure capable of supplying a current to the light emitting diode LD, and may be selected as one of various currently known or later developed structures.

Figure 3:
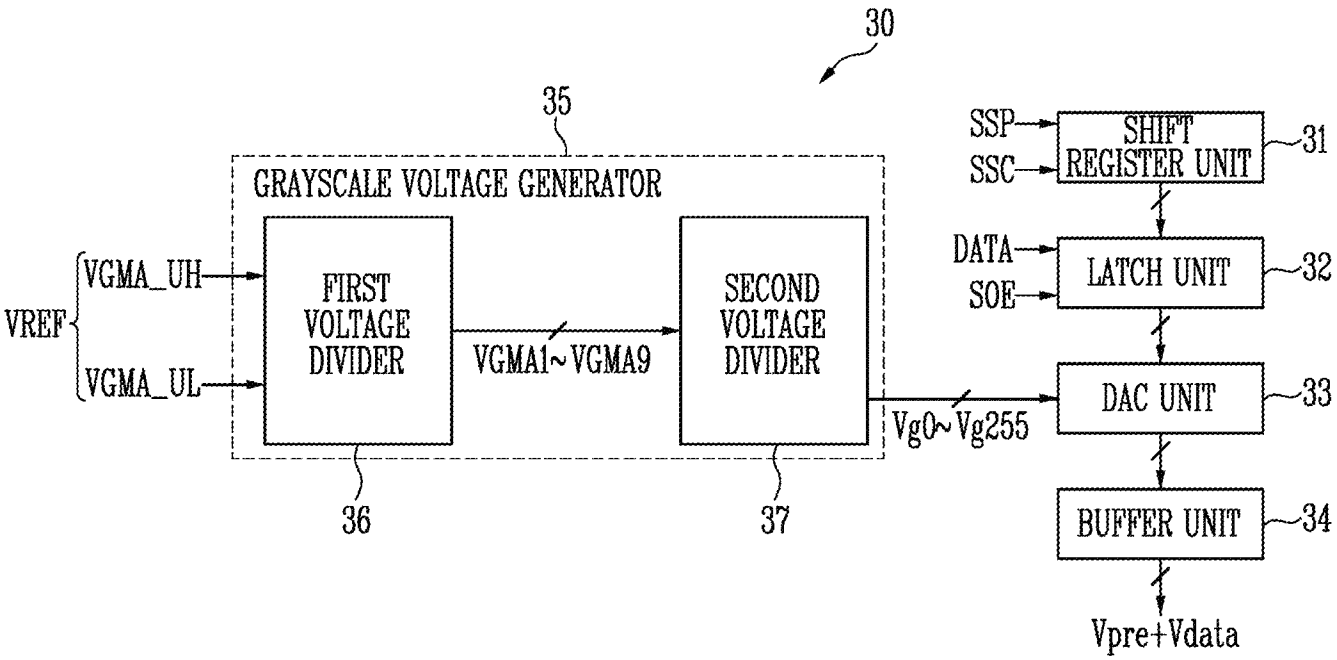
FIG. 3 is a block diagram of a data driver shown in FIG. 1.

FIG. 3 illustrates a detailed configuration of the data driver 30 shown in FIG. 1.

First, referring to FIG. 3, the data driver 30 may include a shift register 31, a latch 32, a digital-to-analog converter (DAC) 33, a buffer 34, and a grayscale voltage generator 35.

The shift register 31 may generate a sequential sampling signal while shifting a source start pulse SSP provided from the timing controller 10 according to a source shift clock SSC within one horizontal period. The shift register 31 may include a plurality of shift registers.

The latch 32 may include a first latch that sequentially latches the data DATA provided from the timing controller 10 in response to the sampling signal provided from the shift register 31 and a second latch that latches data of one horizontal line latched by the first latch in parallel at a rising point of a source output enable signal SOE and supplies the data to the DAC 33.

When the latched data DATA is input from the latch 32, the DAC 33 may generate an analog data voltage corresponding to the digital data DATA and output the data voltage to the buffer 34. The DAC 33 may receive grayscale voltages Vg0 to Vg255 from the grayscale voltage generator 35 to generate a pre-emphasis voltage Vpre and a data voltage Vdata corresponding to the data DATA. The DAC 33 may include a plurality of digital-to-analog converters (DACs).

The buffer 34 may supply the pre-emphasis voltage Vpre and the data voltage Vdata supplied from the DAC 33 to each of the data lines D1 to Dm. Moreover, the buffer 34 may include a plurality of output buffers that are connected to the data lines D1 to Dm in one-to-one correspondence, and the output buffer may be configured with an operational amplifier (OpAmp).

The grayscale voltage generator 35 may divide the gamma reference voltage VREF to generate the grayscale voltages Vg0 to Vg255. Here, the gamma reference voltage VREF may include a high gamma reference voltage VGMA_UH and a low gamma reference voltage VGMA_UL.

In an embodiment, the grayscale voltage generator 35 may include a first voltage divider 36 that divides the gamma reference voltage VREF to generate intermediate gamma reference voltages VGMA1 to VGMA9, and a second voltage divider 37 that divides the intermediate gamma reference voltages VGMA1 to VGMA9 to generate the grayscale voltages Vg0 to Vg255.

The first voltage divider 36 may divide between the high gamma reference voltage VGMA_UH and the low gamma reference voltage VGMA_UL using a plurality of resistance elements connected in series to generate the intermediate gamma reference voltages VGMA1 to VGMA9.

The second voltage divider 37 may divide each adjacent pair of the intermediate gamma reference voltages VGMA1 to VGMA9 using a plurality of resistance elements connected in series to generate the grayscale voltages Vg0 to Vg255.

However, the data driver 30 and the grayscale voltage generator 35 are not limited to the above-described structures, and may be modified to various structures capable of generating the grayscale voltages Vg0 to Vg255 from the gamma reference voltage VREF and outputting the pre-emphasis voltage Vpre and the data voltage Vdata based on the grayscale voltages Vg0 to Vg255 and the data DATA.

Figure 5:
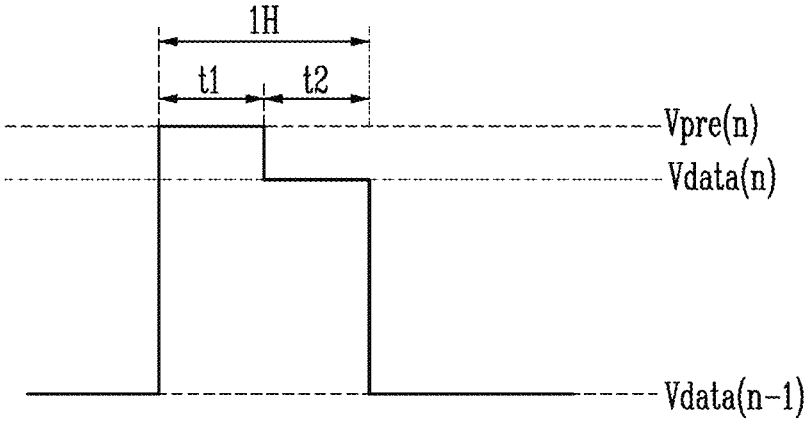
FIG. 5 is a waveform diagram for describing a pre-emphasis voltage and a data voltage.
Figure 6:
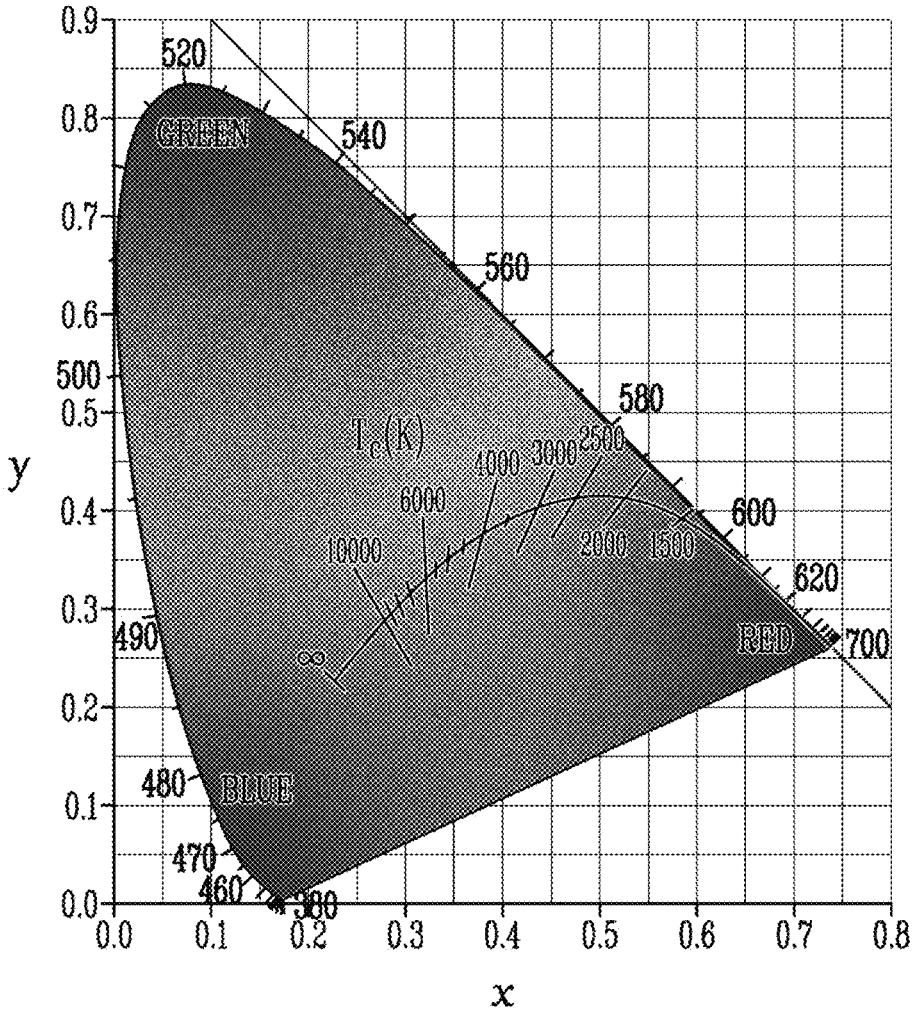
FIG. 6 is a graphical diagram illustrating (x, y) chromaticity in accordance with International Commission on Illumination (CIE) standard of 1931.

FIG. 4 illustrates a lookup table according to an embodiment of the disclosure, and FIG. 5 illustrates a waveform for describing the pre-emphasis voltage and the data voltage. FIG. 6 illustrates a CIE 1931 (x, y) chromaticity diagram. The CIE 1931 (x, y) chromaticity diagram is a standard form of chromaticity diagram created by a standard colorimetric system established in 1931 by the International Commission on Illumination (CIE).

Referring to FIG. 4, an n column of a vertical table direction of the lookup table 15 represents the image data value of the current horizontal period, and an (n−1) row of a horizontal table direction represents the image data value of the previous horizontal period. The data value corresponding to the image data value of the current horizontal period and the image data value of the previous horizontal period represents the pre-emphasis value. In addition, all data values of the lookup table 15 represent a grayscale level.

The data value of a diagonal direction in which the image data value of the current horizontal period and the image data value of the previous horizontal period of the lookup table 15 are the same may correspond to a case where a voltage level of the data signal is not changed. A table value from the lower left based on a center of the data value of the diagonal direction corresponds to a case of increasing from a low grayscale to a high grayscale, and a table value from the upper right based on the center of the data value of the diagonal direction corresponds to a case of decreasing from the high grayscale to the low grayscale.

Referring to FIGS. 4 and 5, the data driver 30 may supply the pre-emphasis voltage Vpre generated based on the pre-emphasis value during a first period t1 of a horizontal period 1H to the data lines D1 to Dm. In addition, the data driver 30 may supply the data voltage Vdata generated based on the image data value during a second period t2 of the horizontal period 1H. Thus, the data signal as supplied by the data driver 30 may include the pre-emphasis voltage Vpre and the data voltage Vdata.

Specifically, the pre-emphasis voltage Vpre has a voltage level higher than the data voltage Vdata at a rising edge of the data signal for values from the lower left of the table; that is, where Vdata(n) is substantially greater than Vdata(n−1).

The timing controller 10 may determine the pre-emphasis grayscale value based on the lookup table 15 in which the pre-emphasis value corresponding to the image data value of the previous horizontal period and the image data value of the current horizontal period is written, without limitation thereto. For example, the intermediate values which are not written in the lookup table 15 may be determined by an interpolation method.

For example, when the image data value of the current horizontal period is 32 grayscales and the image data value of the previous horizontal period is 32 grayscales, the pre-emphasis value is determined as 32 grayscales. Therefore, pre-emphasis is not substantially overdriven.

When the image data value of the current horizontal period is 96 grayscales and the image data value of the previous horizontal period is 0 grayscales, the pre-emphasis value is determined as 129 grayscales. That is, since a data voltage Vdata(n) of the current horizontal period is higher than a data voltage Vdata(n−1) of the previous horizontal period, the pre-emphasis is overdriven and thus a pre-emphasis voltage Vpre(n) of the current horizontal period has a voltage level higher than the data voltage Vdata(n). The pre-emphasis voltage Vpre(n) may be supplied to any of the data lines D1 to Dm during the first period t1 of the current horizontal period, and the data voltage Vdata(n) may be supplied to any of the data lines D1 to Dm during the second period t2.

According to an embodiment of the disclosure, the display device 100 may include a plurality of screen modes. The display device 100 may change a color sense of a screen according to a set target color coordinate. The plurality of screen modes may include a first screen mode having a first target color coordinate, a second screen mode having a second target color coordinate, and a third screen mode having a third target color coordinate. For example, the first screen mode may be a standard mode, the second screen mode may be a warm mode having a red series color sense that has a color temperature lower than that of the standard mode, and the third screen mode may be a cool mode having a blue series color sense that has a color temperature higher than that of the standard mode, without limitation thereto. For example, the number of screen modes is exemplary, and more nuanced screen modes may be provided for user convenience or the like.

Each of the first target color coordinate, the second target color coordinate, and the third target color coordinate may be target color coordinates for maintaining the white balance of the screen displayed by the display device 100 in the respective first screen mode, second screen mode, and/or third screen mode. Each target color coordinate may be a vector represented by a first coordinate and a second coordinate of a rectangular coordinate. For example, in the CIE 1931 (x, y) chromaticity diagram shown in FIG. 6, the first coordinate may be an x coordinate, and the second coordinate may be a y coordinate. Here, a curved boundary line of an outer periphery corresponds to monochromatic light, and a wavelength of each monochromatic light is represented in units of nanometers. The color temperature is mainly expressed in degrees Kelvin. The longer the wavelength, that is, the closer to the red color it is, the lower the color temperature; and the shorter the wavelength, that is, the closer to the blue color it is, the higher the color temperature.

According to an embodiment, the first coordinate and the second coordinate of the second target color coordinate may be larger than the first coordinate and the second coordinate of the first target color coordinate. Conversely, the first coordinate and the second coordinate of the third target color coordinate may be smaller than the first coordinate and the second coordinate of the first target color coordinate. For example, the first target color coordinate of the standard mode may be (0.284, 0.286), the second target color coordinate of the warm mode may be (0.313, 0.329), and the third target color coordinate of the cool mode may be (0.272, 0.278). Here, the color coordinate of the input data DATA (or a reference color coordinate to which the white balance is not applied) may be (0.292, 0.302).

In other words, the first target color coordinate of the second screen mode (or warm mode) may be generally positioned towards the upper right side of the CIE 1931 (x, y) chromaticity diagram compared to the first target color coordinate of the first screen mode (or standard mode). Conversely, the third target color coordinate of the third screen mode (or cool mode) may be generally positioned towards the lower left side of the CIE 1931 (x, y) chromaticity diagram compared to the first target color coordinate of the first screen mode (or standard mode). Therefore, when the user changes the screen mode of the display device 100 from the standard mode towards a warm mode, red or yellow may be emphasized on the screen. Conversely, when the background color of the display device 100 is adjusted towards a cool mode, blue may be emphasized on the screen.

Figure 7A:
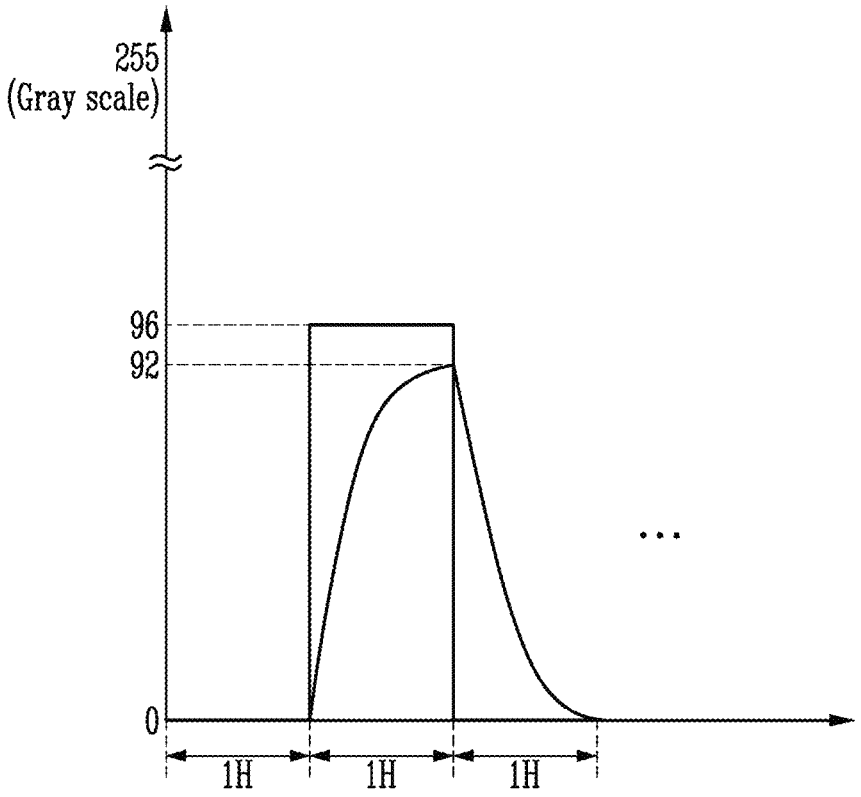
FIGS. 7A to 7C are graphical diagrams for describing a phenomenon in which a white balance is distorted when one screen mode is selected from a plurality of screen modes.
Figure 7B:
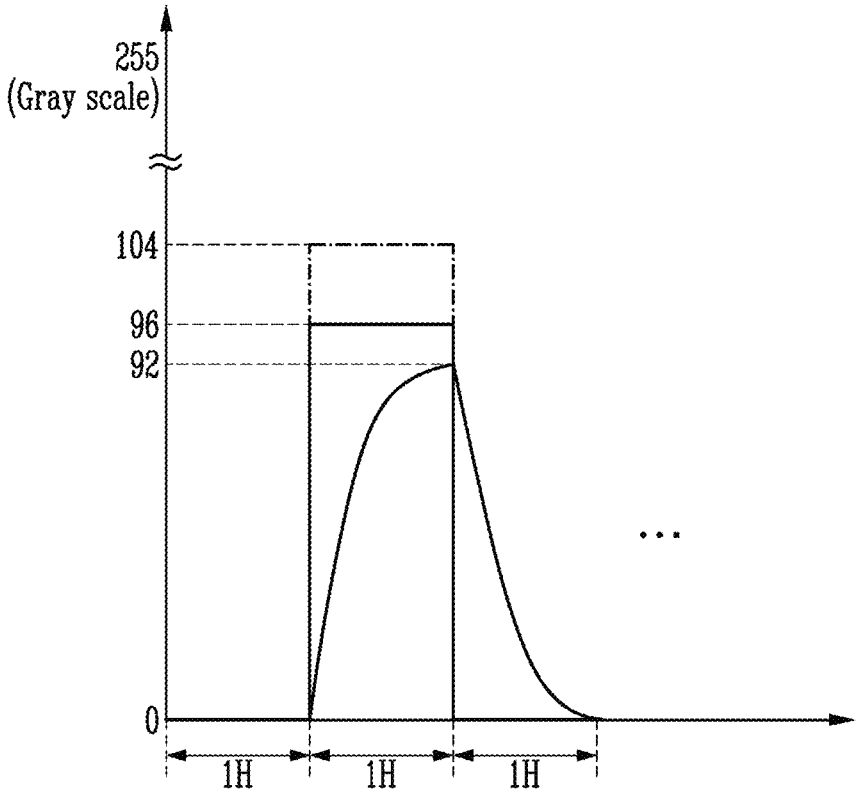
Figure 7C:
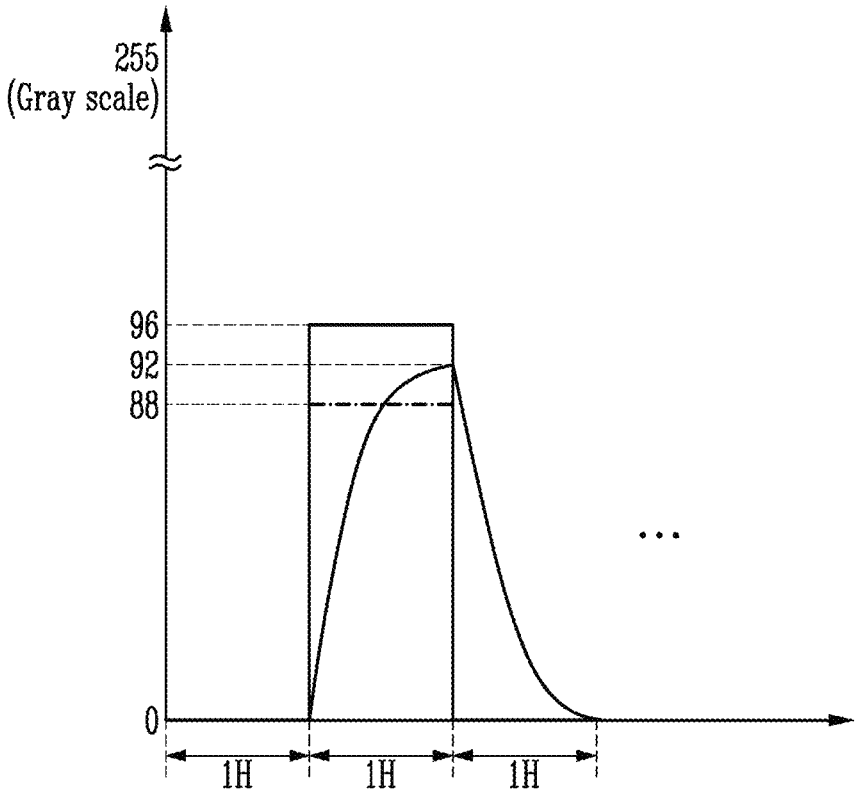
Figure 8:
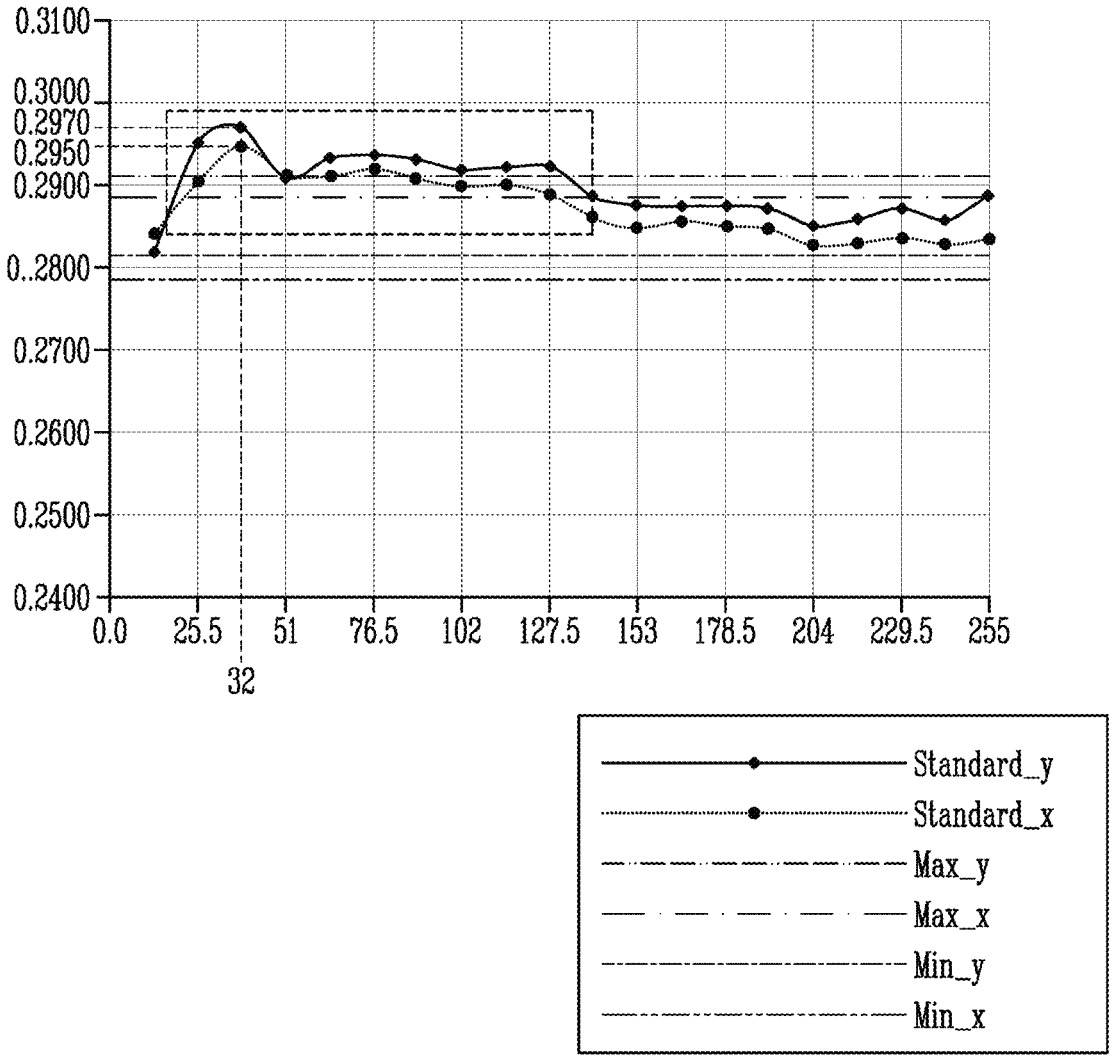
FIG. 8 is a graphical diagram illustrating a color coordinate measured for each grayscale in one screen mode selected from the plurality of screen modes.

FIGS. 7A to 7C illustrate a phenomenon in which the white balance might be distorted when one screen mode is selected from a plurality of screen modes. FIG. 8 graphically illustrates a color coordinate measured for each grayscale in one screen mode selected from the plurality of screen modes.

Referring to FIGS. 1 and 7A to 7C, in order to stably display the image in the pixel array 50, the data signal may be supplied to the pixels PX within a predetermined time (that is, within a period 1H in which the scan signal is supplied). However, the data signal might not be fully charged with a desired target voltage during the period in which the scan signal is supplied due to an increase of resolution and enlargement of the panel.

For example, when the image data value is changed from 0 grayscale to 96 grayscale, in a case where the period (1H) in which the scan signal is supplied is not fully secured, as shown in FIG. 7A, the data signal might not reach a voltage corresponding to 96 grayscale and might only reach a voltage corresponding to 92 grayscale, for example, which would be lower than 96 grayscale by 4 grayscale.

Moreover, when the display device 100 provides the various screen modes, the target color coordinate may be applied differently to each screen mode in order to maintain the white balance of the screen. That is, when the screen mode is changed, the display device 100 may change the data DATA used to display the same image data.

For example, as shown in FIG. 7B, a case might occur where image data expressed in 96 grayscale before the screen mode change is required to be expressed in 104 grayscale after the white balance is applied due to the screen mode change. In this case, the data signal might not reach a voltage corresponding to 104 grayscale and might only reach a voltage corresponding to 92 grayscale, which is lower than 104 grayscale by 12 grayscale. This means that data DATA to display the image data is supplied less fully than in the case shown in FIG. 7A.

Conversely, as shown in FIG. 7C, a case might occur where the image data expressed in 96 grayscale before the screen mode change is to be expressed in 88 grayscale after the white balance is applied due to the screen mode change. In this case, the data signal might exceed a voltage corresponding to 88 grayscale and reach a voltage corresponding to 92 grayscale, which is higher than 88 grayscale by 4 grayscale. This means that the data DATA to display the image data is supplied more than in the case shown in FIG. 7A.

As described above, in a case where the data DATA for displaying the image data is not properly compensated when the screen mode of the display device 100 is changed, linearity of the color coordinate may be non-optimal as shown in FIG. 8.

FIG. 8 graphically illustrates a measured color coordinate of the display device 100 in which the pre-emphasis value is not fully corrected when the screen mode is changed.

Looking at the measured color coordinate, it may be confirmed that the target color coordinate and the measured color coordinate are greatly different in a low grayscale region. For example, the first target color coordinates of the first screen mode may be (0.284, 0.286). A maximum allowable coordinate max_x of the first coordinate (or x coordinate) of the first target color coordinate may be about 0.288, a minimum allowable coordinate minx of the first coordinate (or x coordinate) of the first target color coordinate may be about 0.278, a maximum allowable coordinate max_y of the second coordinate (or y coordinate) of the first target color coordinate may be about 0.291, and a minimum allowable coordinate min_y of the second coordinate (or y coordinate) of the first target color coordinate may be about 0.281. In FIG. 8, it may be seen that the white balance is non-optimal compared to the target color coordinate at 0 to 130 grayscales, in which the measured color coordinate is outside a range of the maximum allowable coordinates max_x and max_y and the minimum allowable coordinates min_x and min_y.

Table 1, below, shows differences between the target color coordinate and the measured color coordinate at a specific grayscale (e.g., 32 grayscale) for each screen mode according to an embodiment.

TABLE 1

| mode | first coordinate of target color coordinate | second coordinate of target color coordinate | first coordinate of actually measured color coordinate | second coordinate of actually measured color coordinate | first coordinate difference | second coordinate difference |
|---|---|---|---|---|---|---|
| color coordinate of input data | 0.292 | 0.302 | — | — | — | — |
| first screen mode (standard mode) | 0.284 | 0.286 | 0.295 | 0.297 | 0.011 | 0.011 |
| second screen mode (warm mode) | 0.313 | 0.329 | 0.342 | 0.372 | 0.029 | 0.043 |
| Third screen mode (cool mode) | 0.272 | 0.278 | 0.260 | 0.270 | −0.012 | −0.008 |

Referring to Table 1, when the lookup table value of FIG. 4 corresponding to the color coordinate of the input data DATA is applied to the first screen mode, the second screen mode, and the third screen mode as it is, the target color coordinate and the measured color coordinate of each screen mode may be different. For example, as shown in FIG. 8, since the measured color coordinate of the first screen mode (or standard mode) is (0.295, 0.297) at 32 grayscale, the measured color coordinate is different from the first target color coordinate (0.284, 0.286) by the color coordinate difference of (0.011, 0.011).

Similarly, since the measured color coordinate of the second screen mode (or warm mode) is (0.342, 0.372), the measured color coordinate is different from the second target color coordinate (0.313, 0.329) by the color coordinate difference of (0.029, 0.043). Since the measured color coordinate of the third screen mode (or cool mode) is (0.260, 0.270), the measured color coordinate is different from the third target color coordinate (0.272, 0.278) by the color coordinates difference of (−0.012, −0.008). If the color coordinate difference is not compensated, the white balance of the display device 100 is non-optimal.

Figure 9:
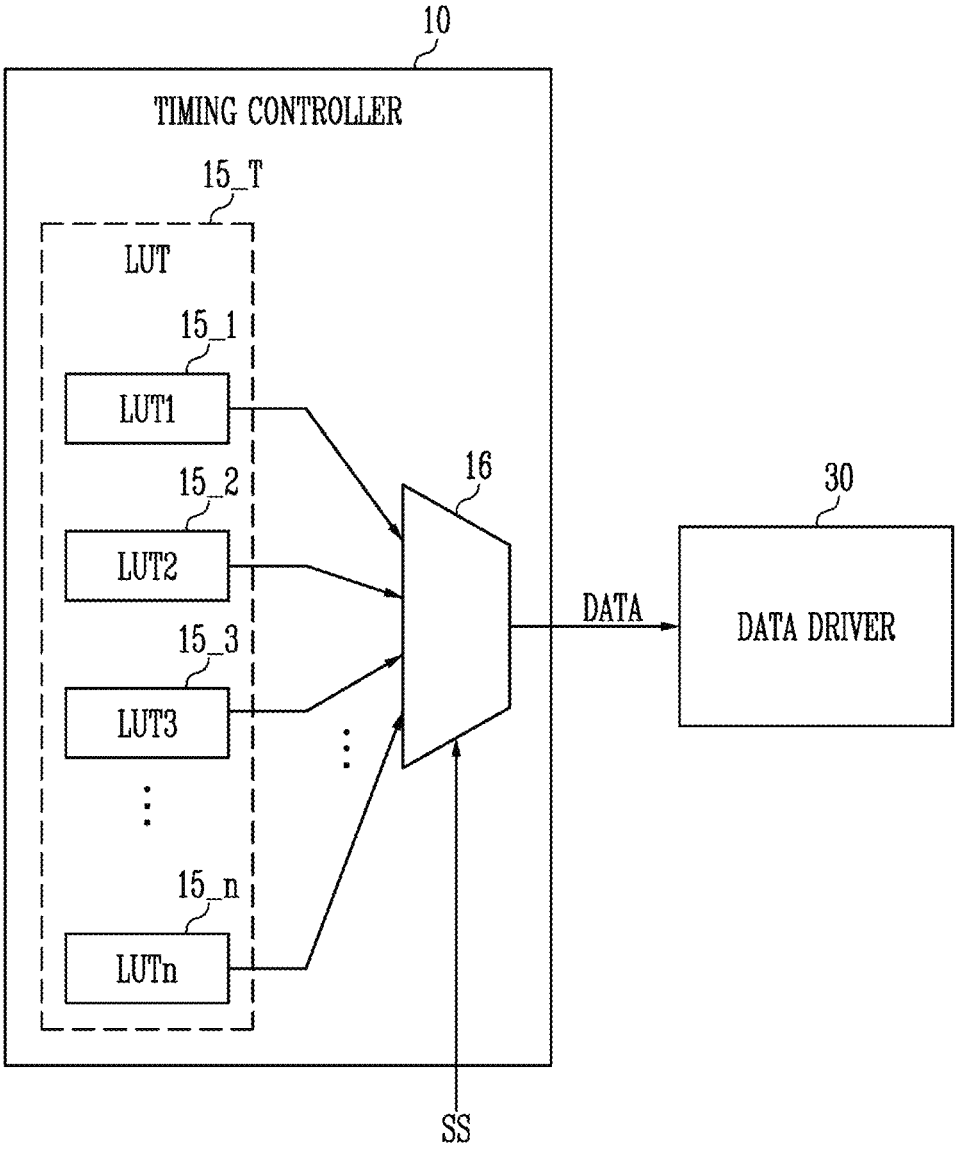
FIG. 9 is a block diagram of a timing controller shown in FIG. 1 according to an embodiment.

FIG. 9 illustrates a detailed configuration of the timing controller shown in FIG. 1, according to an embodiment. FIGS. 10A to 100 are lookup tables created for each of three corresponding screen modes according to an embodiment.

Referring to FIGS. 9 and 10A to 10B, the timing controller 10 may include a paged lookup table 15_T and a lookup table selector 16.

According to an embodiment of the disclosure, the timing controller 10 may calculate the data DATA in which a difference of color coordinates is compensated, and provide the calculated data DATA to the data driver 30.

For example, when the first screen mode is selected, the timing controller 10 may obtain a difference value between the first target color coordinate and the measured color coordinate for each grayscale, calculate a first compensation value using the difference value, and add the first compensation value to the pre-emphasis value. Accordingly, the timing controller 10 may provide the data DATA changed or compensated in correspondence with the first screen mode to the data driver 30.

Similarly, when the second screen mode is selected, the timing controller 10 may obtain a difference value between the second target color coordinate and the measured color coordinate for each grayscale, calculate a second compensation value using the difference value, and add the second compensation value to the pre-emphasis value. Accordingly, the timing controller 10 may provide the data DATA, changed or compensated in correspondence with the second screen mode, to the data driver 30.

In addition, when the third screen mode is selected, the timing controller 10 may obtain a difference value between the third target color coordinate and the measured color coordinate for each grayscale, calculate a third compensation value using the difference value, and add the third compensation value to the pre-emphasis value. Accordingly, the timing controller 10 may provide the data DATA, changed or compensated in correspondence with the third screen mode, to the data driver 30.

The second compensation value for the second screen mode (or warm mode) may be greater than or equal to the first compensation value for the first screen mode (or standard mode), and the third compensation value for the third screen mode (or cool mode) may be less than or equal to the first compensation value for the first screen mode (or standard mode). For example, the first to third compensation values may be calculated using the following Equation 1. The first compensation value calculated using the equation may be 11, the second compensation value may be 57, and the third compensation value may be −4. Here, the first to third compensation values indicate grayscale levels.

$$\text{compensation value}=(\Delta y/0.001)+(\Delta y-\Delta x)/0.001 \quad \text{(Equation 1)}$$

(where Δx is a difference value between the target coordinate and the first coordinate of the measured coordinate, and Δy is a difference value between the target coordinate and the second coordinate of the measured coordinate)

Using a formula when calculating the first to third compensation values is exemplary, and a method of calculating the first to third compensation values may be variously implemented experimentally or statistically according to a tuning result from testing the display device 100.

According to an embodiment of the disclosure, the timing controller 10 may determine the pre-emphasis grayscale value based on the lookup tables 15_1 to **15_*n* selected by the selector 16 from among the plurality of lookup tables of the paged lookup table 15**_T.

The lookup table 15_T may include the lookup tables 15_1 to **15_*n* for the respective screen modes. For example, the first lookup table 15_1 for the first screen mode (or standard mode), the second lookup table 15_2 for the second screen mode (or warm mode), the third lookup table 15_3 for the third screen mode (or cool mode), and the n-th lookup table 15_*n* for an n-th screen mode may be included. The lookup table 15 shown in FIG. 4** may be a reference lookup table corresponding to the color coordinate (or the reference color coordinate to which the white balance is unapplied) of the input data DATA.

The pre-emphasis value included in the second lookup table 15_2 may be greater than or equal to the pre-emphasis value included in the corresponding first lookup table 15_1, and the pre-emphasis value included in the third look-up table 15_3 may be less than or equal to the pre-emphasis value included in the corresponding first look-up table 15_1.

Referring to FIGS. 4 and 10A to 10C, an n column of the vertical direction of the lookup tables 15, 15_1, 15_2, and 15_3 represents the image data value Vdata(n) of the current horizontal period n, and an (n−1) column of the horizontal direction represents the image data value Vdata(n−1) of the previous horizontal period n−1. When the image data values corresponding to the same row and column are compared with each other, 11 grayscale is generally added to the first lookup table 15_1 compared to the reference lookup table 15, 57 grayscale is generally added to the second lookup table 15_2 compared to the reference lookup table 15, and −4 grayscale is generally added to the third lookup table 15_3 compared to the reference lookup table 15. This may mean adding each of the first to third compensation values calculated through the equation to the reference lookup table 15.

The timing controller 10 may receive a lookup table selection signal SS through the lookup table selector 16, and may provide data based on the lookup tables 15_1 to **15_*n*, corresponding to the lookup table selection signal SS, to the data driver 30**.

According to an embodiment, the lookup table selection signal SS may be generated by an input of the user of the display device 100. However, the disclosure is not limited thereto. A surrounding environment may be sensed through various sensors mounted on the display device 100, an application processor of the display device 100 may select any one of the plurality of screen modes based on the sensed information, and thus the lookup table selection signal SS may be automatically generated.

Figure 11:
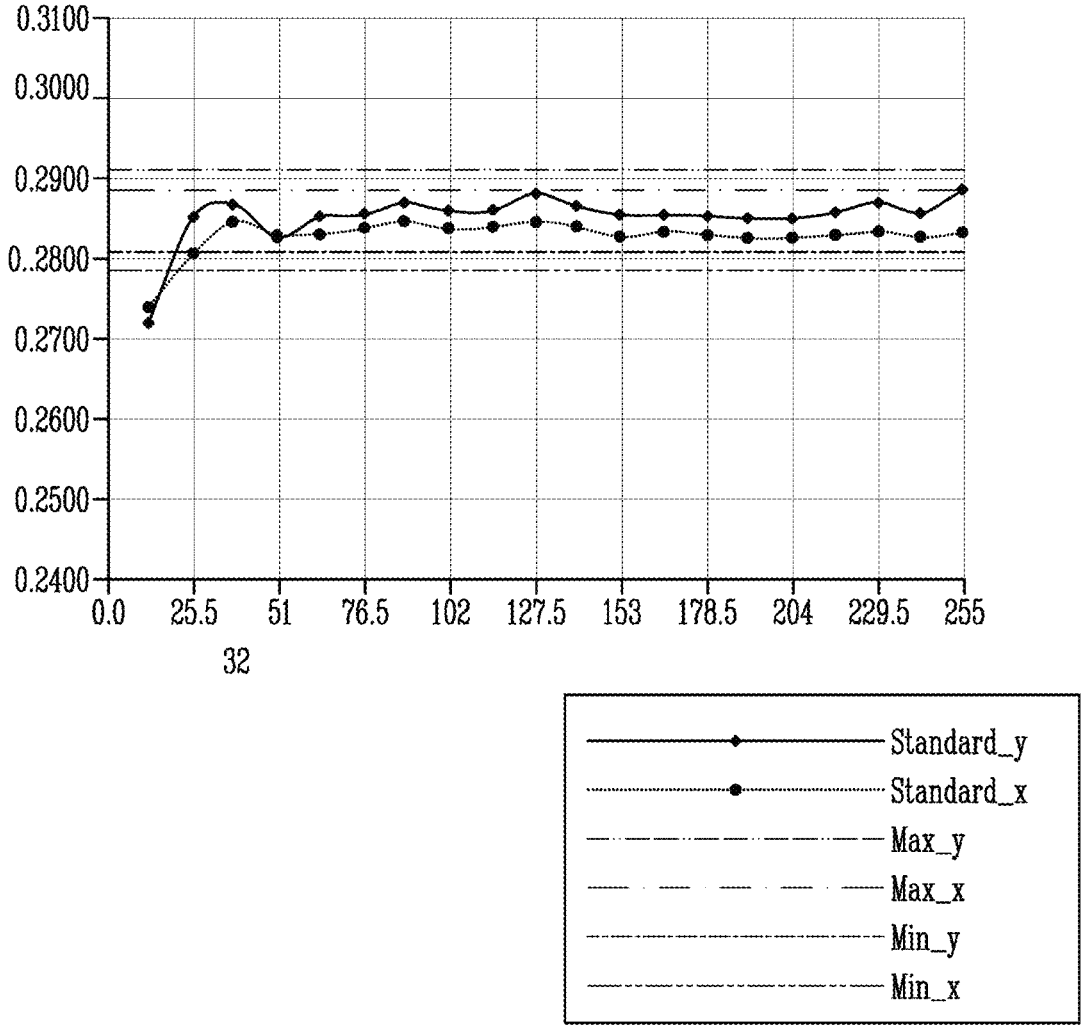
FIG. 11 is a graphical diagram illustrating the measured color coordinate of the display device 100 in which a pre-emphasis value is corrected when the screen mode is changed.

FIG. 11 graphically illustrates the measured color coordinate of the display device 100 in which the pre-emphasis value is corrected when the screen mode is changed.

According to an embodiment of the disclosure, the timing controller 10 may provide the data driver 30 with data in which the pre-emphasis value is changed in correspondence with one screen mode, selected from the plurality of screen modes having different target color coordinates. Therefore, the effect that the white balance is maintained at all grayscales may be achieved.

Looking at the measured color coordinate shown in FIG. 11, compared to the measured color coordinate shown in FIG. 8, it may be confirmed that the measured color coordinates standard_x and standard_y are positioned within a range of maximum allowable coordinates max_x and max_y and minimum allowable coordinates min_x and min_y in the low grayscale region.

Figure 12:
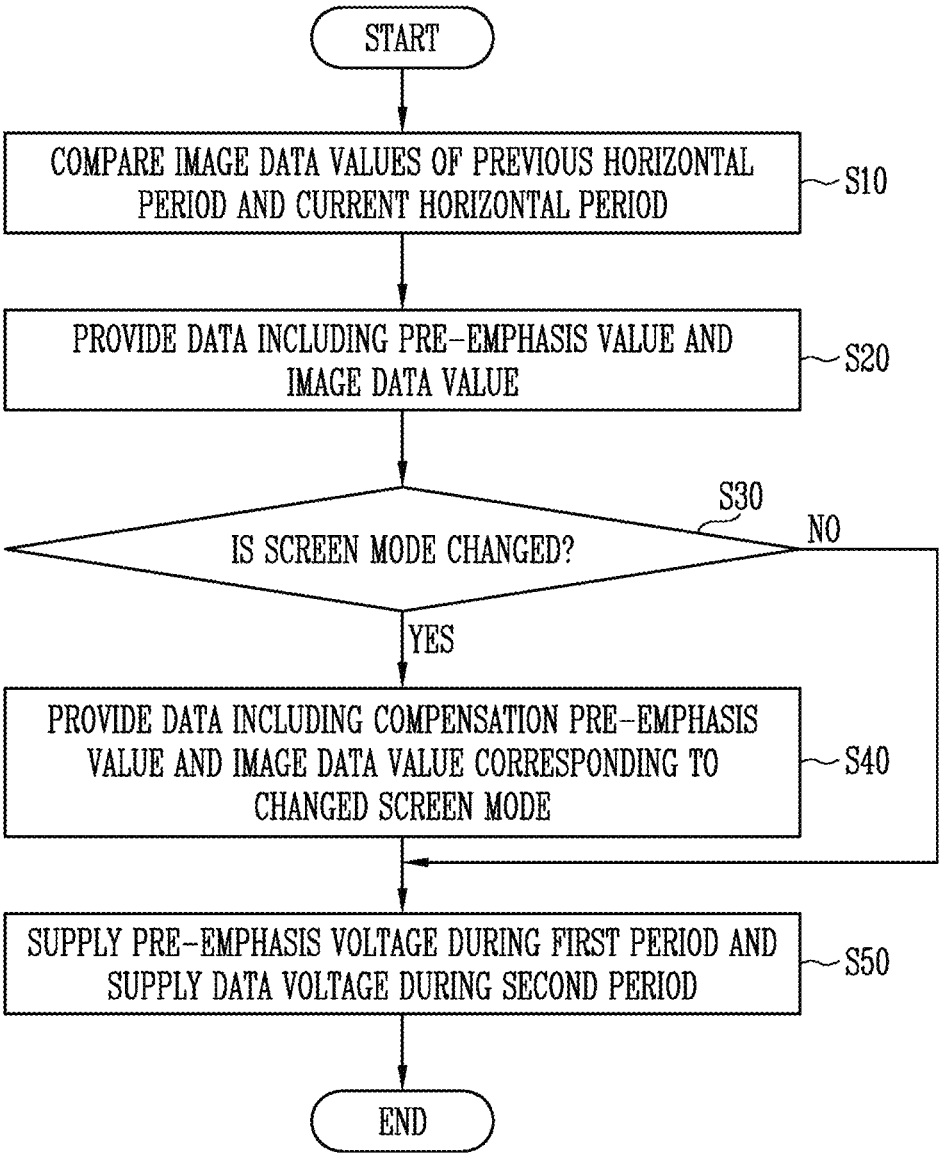
FIG. 12 is a flowchart diagram illustrating a method of driving the display device according to an embodiment of the disclosure.

FIG. 12 illustrates a method of driving the display device according to an embodiment of the disclosure.

Referring to FIG. 12, in the method of driving the display device 100 according to an embodiment of the disclosure, the timing controller 10 compares the image data values of the previous horizontal period and the current horizontal period at step S10. Specifically, the timing controller 10 may compare the image data value of the previous horizontal period with the image data value of the current horizontal period to determine the pre-emphasis value corresponding to the current horizontal period.

In an embodiment, the timing controller 10 may determine the pre-emphasis grayscale value based on the lookup table 15 in which the pre-emphasis value is maintained corresponding to the image data value of the previous horizontal period and the image data value of the current horizontal period.

The timing controller 10 provides the data DATA including the pre-emphasis value and the image data value to the data driver 30 at step S20. The timing controller 10 corrects the image data input from the outside to be suitable for the image display of the pixel PX in the pixel array 50 and supplies the corrected data DATA to the data driver 30. The timing controller 10 may change a time-wise part of the image data value to the determined pre-emphasis value.

The timing controller 10 determines whether the screen mode of the display device 100 is changed through whether the lookup table selection signal SS is received at step S30. According to an embodiment, the lookup table selection signal SS may be generated by the input of the user of the display device 100. However, the disclosure is not limited thereto. A surrounding environment may be sensed through various sensors mounted on the display device 100, an application processor (not shown) of the display device 100 may select any one of the plurality of screen modes based on the sensed information, and thus the lookup table selection signal SS may be generated.

The plurality of screen modes may include the first screen mode having the first target color coordinate, the second screen mode having the second target color coordinate, and the third screen mode having the third target color coordinate. For example, the first screen mode may be a standard mode, the second screen mode may be a warm mode having a red series color sense that has a color temperature lower than that of the standard mode, and the third screen mode may be a cool mode having a blue series color sense that has a color temperature higher than that of the standard mode.

Upon performance of step S30, when it is determined that the screen mode is changed, the timing controller 10 provides the data including the compensation pre-emphasis value and the image data value corresponding to the changed screen mode to the data driver 30 at step S40.

According to an embodiment of the disclosure, the timing controller 10 may calculate the data DATA in which the difference in the color coordinate is compensated, and provide the calculated data DATA to the data driver 30.

For example, when any one of the screen modes is selected, the timing controller 10 may obtain a difference value between the target color coordinate and the measured color coordinate for each grayscale, calculate the compensation value using the difference value, and add the compensation value to the pre-emphasis value. Accordingly, the timing controller 10 may provide the data driver 30 with the data DATA changed or compensated in correspondence with the selected screen mode.

For example, the compensation value may be calculated using the above-described formula. Here, the compensation value represents a grayscale level.

The timing controller 10 may provide the data driver 30 with the data by which the pre-emphasis value is changed in correspondence with one screen mode selected from the plurality of screen modes having different target color coordinates, and thus the white balance may be maintained at all grayscales.

The data driver 30 supplies the pre-emphasis voltages to the data lines D1 to Dm during the first period, and supplies the data voltages to the data lines D1 to Dm during the second period at step S50.

The data driver 30 may receive the gamma reference voltage VREF from the gamma reference voltage supply 20.

The data driver 30 may supply the pre-emphasis voltage generated based on the pre-emphasis value and the gamma reference voltage VREF during the first period of the horizontal period to the data lines D1 to Dm. In addition, the data driver 30 may supply the data voltage generated based on the image data value and the gamma reference voltage VREF during the second period of the horizontal period. The data signal may include the pre-emphasis voltage and the data voltage.

Although the present disclosure has been described with reference to exemplary embodiments thereof, it will be understood by those of ordinary skill in the pertinent art that the disclosure may be variously modified and changed without departing from the scope and spirit of the disclosure as set forth in the following claims.

What is claimed is:

1. A display device comprising:

a timing controller which provides data comprising a pre-emphasis value and an image data value; and a data driver which supplies to data lines a pre-emphasis voltage generated based on the pre-emphasis value during a first period of a horizontal period, and supplies to the data lines a data voltage generated based on the image data value during a second period of the horizontal period, wherein the timing controller provides data based on which the pre-emphasis value is changed in correspondence with one screen mode selected from a plurality of screen modes having different target color coordinates, and wherein when each of the plurality of screen modes is selected, the timing controller obtains a difference value between a target color coordinate corresponding to selected screen mode and a measured color coordinate for each grayscale, calculates a corresponding compensation value using the difference value, and adds the corresponding compensation value to the pre-emphasis value.

2. The display device according to claim 1, wherein the plurality of screen modes comprises a first screen mode having a first target color coordinate, a second screen mode having a second target color coordinate, and a third screen mode having a third target color coordinate.

3. The display device according to claim 2, wherein:

each of the first to third target color coordinates comprises a first coordinate and a second coordinate of rectangular coordinates, the first coordinate and the second coordinate of the second target color coordinate are greater than the first coordinate and the second coordinate of the first target color coordinate, and the first coordinate and the second coordinate of the third target color coordinate are less than the first coordinate and the second coordinate of the first target color coordinate.

4. The display device according to claim 2, wherein the timing controller compares the image data value of a previous horizontal period with the image data value of a current horizontal period to determine the pre-emphasis value corresponding to the current horizontal period.

5. The display device according to claim 2, wherein the timing controller determines the pre-emphasis value based on a lookup table containing the pre-emphasis value corresponding to the image data value of a previous horizontal period and the image data value of a current horizontal period.

6. The display device according to claim 5, wherein the lookup table comprises a first lookup table corresponding to the first mode, a second lookup table corresponding to the second mode, and a third lookup table corresponding to the third mode.

7. The display device according to claim 6, wherein the pre-emphasis value comprised by the second lookup table is greater than or equal to the pre-emphasis value comprised by the corresponding first lookup table, and the pre-emphasis value comprised by the third lookup table is less than or equal to the pre-emphasis value comprised by the corresponding first lookup table.

8. The display device according to claim 1, further comprising:

a gamma reference voltage supply which supplies a gamma reference voltage, wherein the gamma reference voltage comprises a lowest gamma reference voltage corresponding to a lowest grayscale value and a highest gamma reference voltage corresponding to a highest grayscale value.

9. The display device according to claim 8, wherein the data driver comprises a grayscale voltage generator that divides the gamma reference voltage to generate a plurality of grayscale voltages.

10. The display device according to claim 9, wherein the data driver selects any one of the grayscale voltages corresponding to the pre-emphasis value to generate the pre-emphasis voltage, and selects any one of the grayscale voltages corresponding to the image data value to generate the data voltage.

11. The display device according to claim 1, further comprising:

a scan driver which supplies a scan signal through scan lines; and a pixel array comprising a plurality of pixels connected to the scan lines and the data lines.

12. A display device, comprising:

a timing controller which provides data comprising a pre-emphasis value and an image data value; and a data driver which supplies to data lines a pre-emphasis voltage generated based on the pre-emphasis value during a first period of a horizontal period, and supplies to the data lines a data voltage generated based on the image data value during a second period of the horizontal period, wherein the timing controller provides data based on which the pre-emphasis value is changed in correspondence with one screen mode selected from a plurality of screen modes having different target color coordinates, wherein the plurality of screen modes comprises a first screen mode having a first target color coordinate, a second screen mode having a second target color coordinate, and a third screen mode having a third target color coordinate, wherein the timing controller compares the image data value of a previous horizontal period with the image data value of a current horizontal period to determine the pre-emphasis value corresponding to the current horizontal period, when the first screen mode is selected, the timing controller obtains a difference value between the first target color coordinate and a measured color coordinate for each grayscale, calculates a first compensation value using the difference value, and adds the first compensation value to the pre-emphasis value, when the second screen mode is selected, the timing controller obtains a difference value between the second target color coordinate and the measured color coordinate for each grayscale, calculates a second compensation value using the difference value, and adds the second compensation value to the pre-emphasis value, and when the third screen mode is selected, the timing controller obtains a difference value between the third target color coordinate and the measured color coordinate for each grayscale, calculates a third compensation value using the difference value, and adds the third compensation value to the pre-emphasis value.

13. The display device according to claim 12, wherein the first to third compensation values are calculated as:

$$\text{compensation value}=(\Delta y/0.001)+(\Delta y-\Delta x)/0.001$$

(where Δx is a difference value between a target coordinate and a first coordinate of a measured coordinate, and Δy is a difference value between the target coordinate and a second coordinate of the measured coordinate).

14. The display device according to claim 12, wherein the second compensation value is greater than or equal to the first compensation value, and the third compensation value is less than or equal to the first compensation value.

15. A method of driving a display device, the method comprising:

providing data comprising a pre-emphasis value and an image data value;

supplying a gamma reference voltage; and supplying to data lines a pre-emphasis voltage generated based on the pre-emphasis value and the gamma reference voltage during a first period of a horizontal period, supplying to the data lines a data voltage generated based on the image data value and the gamma reference voltage during a second period of the horizontal period, wherein, in providing the data comprising the pre-emphasis value and the image data value, the pre-emphasis value is changed in correspondence with one screen mode selected from a plurality of screen modes having different target color coordinates, and wherein providing the data comprising the pre-emphasis value and the image data value further comprises, when one of the plurality of screen modes is selected, obtaining a difference value between a target color coordinate corresponding to the one of the plurality of screen modes and a measured color coordinate for each grayscale, calculating corresponding compensation value using the difference value, and adding the corresponding compensation value to the pre-emphasis value.

16. The method according to claim 15, wherein the plurality of screen modes comprises a first screen mode having a first target color coordinate, a second screen mode having a second target color coordinate, and a third screen mode having a third target color coordinate.

17. The method according to claim 16, wherein:

each of the first to third target color coordinates comprises a first coordinate and a second coordinate of rectangular coordinates, the first coordinate and the second coordinate of the second target color coordinate are greater than the first coordinate and the second coordinate of the first target color coordinate, and the first coordinate and the second coordinate of the third target color coordinate are less than the first coordinate and the second coordinate of the first target color coordinate.

18. The method according to claim 16, wherein providing the data comprising the pre-emphasis value and the image data value comprises comparing the image data value of a previous horizontal period with the image data value of a current horizontal period to determine the pre-emphasis value corresponding to the current horizontal period.

19. The method according to claim 18, wherein providing the data comprising the pre-emphasis value and the image data value further comprises:

when the first screen mode is selected, obtaining a difference value between the first target color coordinate and a measured color coordinate for each grayscale, calculating a first compensation value using the difference value, and adding the first compensation value to the pre-emphasis value;

when the second screen mode is selected, obtaining a difference value between the second target color coordinate and the measured color coordinate for each grayscale, calculating a second compensation value using the difference value, and adding the second compensation value to the pre-emphasis value; and when the third screen mode is selected, obtaining a difference value between the third target color coordinate and the measured color coordinate for each grayscale, calculating a third compensation value using the difference value, and adding the third compensation value to the pre-emphasis value.

20. The method according to claim 19, wherein the first to third compensation values are calculated as:

$$\text{compensation value}=(\Delta y/0.001)+(\Delta y-\Delta x)/0.001$$

(where Δx is a difference value between a target coordinate and a first coordinate of a measured coordinate, and Δy is a difference value between the target coordinate and a second coordinate of the measured coordinate).

* * * * *